US010985478B1

(12) United States Patent
Leahy et al.

(10) Patent No.: US 10,985,478 B1
(45) Date of Patent: Apr. 20, 2021

(54) LOW PROFILE LIGHTING ADAPTERS

(71) Applicant: Lumenture, LLC, Redding, CT (US)

(72) Inventors: James D. Leahy, Redding, CT (US); Andrew F. Sack, Redding, CT (US)

(73) Assignee: Lumenture, LLC, Redding, CT (US)

( * ) Notice: Subject to any disclaimer, the term of this patent is extended or adjusted under 35 U.S.C. 154(b) by 0 days.

(21) Appl. No.: 16/279,570

(22) Filed: Feb. 19, 2019

Related U.S. Application Data

(60) Provisional application No. 62/631,676, filed on Feb. 17, 2018.

(51) Int. Cl.

| | |
|---|---|
| ***H01R 25/14*** | (2006.01) |
| ***H01R 9/24*** | (2006.01) |
| ***F21V 23/06*** | (2006.01) |
| ***F21V 21/30*** | (2006.01) |

(52) U.S. Cl.
CPC ..... *H01R 9/2416* (2013.01); *F21V 21/30* (2013.01); *F21V 23/06* (2013.01); *H01R 9/2483* (2013.01)

(58) Field of Classification Search
CPC ..... F21V 21/30; H01R 9/2416
USPC ..... 439/110, 117, 118, 121, 122; 362/648
See application file for complete search history.

(56) References Cited

U.S. PATENT DOCUMENTS 1,096,440 A * 5/1914 Lynch ..... F21S 6/002 362/269
1,401,820 A * 12/1921 Sills ..... F21V 21/35 248/297.21
2,673,966 A * 3/1954 Larkin ..... F21V 21/22 439/10
3,585,564 A * 6/1971 Skjervoll ..... H01R 39/00 439/21
3,680,030 A * 7/1972 Johnson ..... H02G 5/04 439/10
4,181,388 A * 1/1980 Donato ..... H01R 25/142 439/122
4,688,154 A * 8/1987 Nilssen ..... F21V 21/35 307/157
5,833,358 A * 11/1998 Patik ..... H01R 25/147 362/391
5,855,485 A * 1/1999 Patti ..... H01R 25/142 439/121
6,170,967 B1 * 1/2001 Usher ..... F21V 23/06 200/227

(Continued)

*Primary Examiner* — Neil Abrams
(74) *Attorney, Agent, or Firm* — Winthrop & Weinstine, P.A.

(57) ABSTRACT

A low profile lighting adapter can include a first housing section configured to hold an electrical ground connection, and a second housing section configured to couple with the first housing section, the second housing section including a planar surface orthogonal to the first housing section. The low profile lighting adapter can include a second electrical connection disposed in the first housing section and opposite of a first electrical connection, wherein the first housing section is configured to allow individual actuation of the second electrical connection along an axis orthogonal to a planar surface of the second housing section. The low profile lighting adapter can include an extending arm coupled to the second housing section and configured to rotate about the axis. Certain of the disclosed embodiments can permit a live connection to be individually set at different levels to engage different electrical circuits on a light track.

16 Claims, 21 Drawing Sheets

(56) References Cited

U.S. PATENT DOCUMENTS

| | | | | |
|---|---|---|---|---|
| 6,244,733 | B1 * | 6/2001 | Fong | F21V 21/35<br>362/147 |
| 7,798,824 | B2 * | 9/2010 | Fong | H01R 33/22<br>362/147 |
| 9,739,460 | B2 * | 8/2017 | Haubach | F21V 19/04 |

* cited by examiner

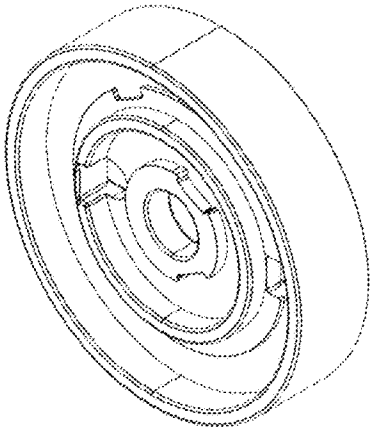
FIG. 15A
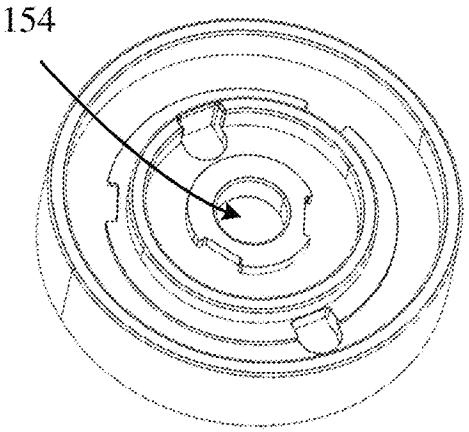
FIG. 15B
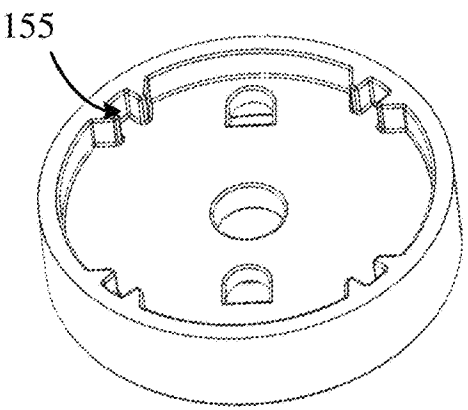
FIG. 15C
FIG. 15D
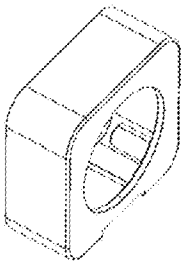
FIG. 15E
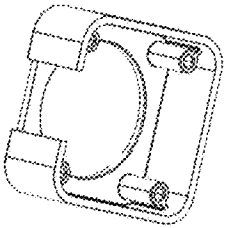
FIG. 15F
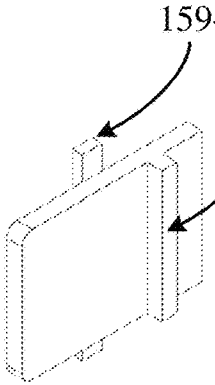
FIG. 15G
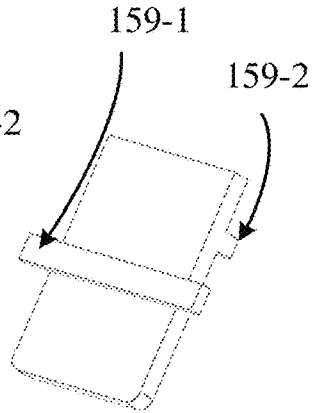
FIG. 15H

LOW PROFILE LIGHTING ADAPTERS

CROSS-REFERENCE TO RELATED APPLICATION

The present patent application claims the benefit of priority to U.S. Provisional Patent Application No. 62/631,676, filed Feb. 17, 2018. This patent application is incorporated by reference herein in its entirety for any purpose whatsoever.

FIELD

The present disclosure relates to lighting devices, particularly lighting adapters.

BACKGROUND

Various types of lighting devices, such as track lighting are ubiquitous and have experienced widespread adoptions in myriad applications. But, these systems still have certain deficiencies. The present disclosure provides embodiments that address these and other deficiencies.

SUMMARY OF THE DISCLOSURE

The present disclosure provides various improvements to the state of the art in lighting systems.

In some embodiments, the disclosure provides a lighting adapter configured to be received by a lighting track. The adapter includes a housing including a plurality of electrical conductors directed therethrough, wherein at least one of said conductors includes at least one slidable conductive portion and a second portion. The at least one slidable conductive portion can be configured to slide over and with respect to the second portion to permit a lengthwise adjustment of the conductor, wherein the at least one slidable conductive portion can be slid with respect to the second portion to contact at least one of a plurality of different conductors in the light track.

In some embodiments, the at least one slidable conductive portion can slide along a linear direction with respect to the second portion. A first portion of said at least one slidable conductive portion can further include an angled portion that can be configured to contact a conductor in a lighting track. The angled portion can oriented orthogonally with respect to the remainder of the at least one slidable conductive portion, or at a different angle, such as an angle between about five and about 175 degrees, in increments of about one degree.

If desired, the at least one slidable conductive portion can be configured to make electrical contact with a first electrical circuit in a lighting track in a first position, and to make electrical contact with a second electrical circuit in the lighting track in a second position.

In some implementations, the lighting adapter can further include at least one rotatable conductor permitting continuous rotatable adjustment of the lighting adapter about an axis of rotation while maintaining electrical continuity through the at least one rotatable conductor. Preferably, the at least one rotatable conductor does not include a mechanical stop so that a luminaire, for example, attached to the lighting adapter can be rotated as much as desired. If desired, the at least one rotatable conductor can be rotated in excess of a predetermined quantity, such as more than 360 degrees, or any incremental amount in excess of 360 degrees, in increments of one degree, such as between 360 and 720 degrees in increments of one degree, or any other desired amount. In some implementations, the at least one rotatable conductor can include at least one conductive ring. The at least one conductive ring can have an undulating shape along a circumferential direction.

The disclosure further provides a lighting adapter configured to be received by a lighting track. The adapter includes a housing including a plurality of electrical conductors directed therethrough, wherein at least one of said conductors includes at least one rotatable conductor permitting continuous rotatable adjustment of the lighting adapter about an axis of rotation while maintaining electrical continuity through the at least one rotatable conductor. If desired, the at least one rotatable conductor can be rotated in excess of 360 degrees, 720 degrees, or any other desired amount. In some implementations, the at least one rotatable conductor can include at least one conductive ring. The at least one conductive ring can have an undulating shape along a circumferential direction.

The disclosure further provides a low profile lighting adapter that includes a first housing section configured to hold an electrical ground connection, and a second housing section configured to couple with the first housing section. The second housing section includes a planar surface and an extension orthogonal to the planar surface. The extension can be configured to couple with the first housing section. The adapter further includes a first electrical lead disposed between the first housing section and the second housing section, and a second electrical lead disposed in the first housing section and opposite of the electrical ground connection. The first housing section can be configured to allow individual actuation of the second electrical lead along first direction by a relative sliding action along and with respect to a further conductor, wherein a first end of said second electrical lead slides along said further conductor. The adapter can further include an extending arm coupled to the second housing section and can be configured receive a lighting apparatus, such as a luminaire.

In some embodiments, the extending arm can be configured to allow the lighting apparatus to rotate about a first axis without an angular rotational limit.

The disclosure further includes a lighting assembly that includes any of the lighting adapters as described herein, coupled to a luminaire, for coupling to a lighting track, for example. But, the disclosed embodiments can also include a lighting device, such as any kind of a lamp or other lighting fixture wherein the light emitting portion of the device is coupled to a base by a rotatable connector as disclosed herein that can be rotated as much as desired. The disclosure also provides lighting systems herein that include lighting tracks combined with any of the disclosed lighting adapters and luminaires (or other electrical devices, such as a WiFi signal repeater) as appropriate.

These and other features, advantages, and objects of the present disclosure will be further understood and appreciated by those skilled in the art by reference to the following specification, claims, and appended drawings.

BRIEF DESCRIPTION OF THE DRAWINGS

FIGS. 15A-15H illustrate various expanded views of various components of the low profile lighting adapter described herein.

DETAILED DESCRIPTION

The present disclosure provides improvements to the current state of the art of lighting fixtures. In particular illustrative embodiments, track lighting is illustrated, although it will be appreciated that certain aspects of the disclosure relate to lighting generally.

Applicant has observed that typical track lighting adapters are required to have a mechanical "stop" to ensure the electrical wires inside the adapter are not damaged by over-rotation. However, Applicant also appreciates that such rotation limitations can be found in many types of lighting devices, and not only track lighting. Thus, in accordance with one aspect, the disclosure provides implementations of electrical connectors that permit any desired amount of rotation in a lighting circuit. While this is illustrated with respect to a luminaire for a track lighting system, it will be appreciated that the disclosed implementations can be applied to many types of lighting systems, including lamps and the like.

In accordance with further embodiments, the present disclosure provides implementations of improved two-circuit adapters for track lighting systems. In some conventional two-circuit adapters, one of the copper connectors can be set at two different, discrete levels. One level makes electrical contact with the first electrical circuit on the track, the other level makes electrical contact with a second electrical circuit, thus allowing two light switches to control two sets of lights on a single conductive track assembly. Because such an electrical connector needs to have the ability to move up and down, such two-circuit track adapters typically have taller housings. In accordance with the present disclosure, improved adapters with lower profile housings are provided by providing conductors with an adjustable linear length, as set forth herein. While these conductors are particularly illustrated as providing electrical pathways for a live electrical feed, it will be appreciated that such connections can be configured for use with neutral and ground connections, as desired.

It will be appreciated that other novel, useful, and non-obvious aspects and embodiments providing additional advantages are provided herein.

Figure 1:
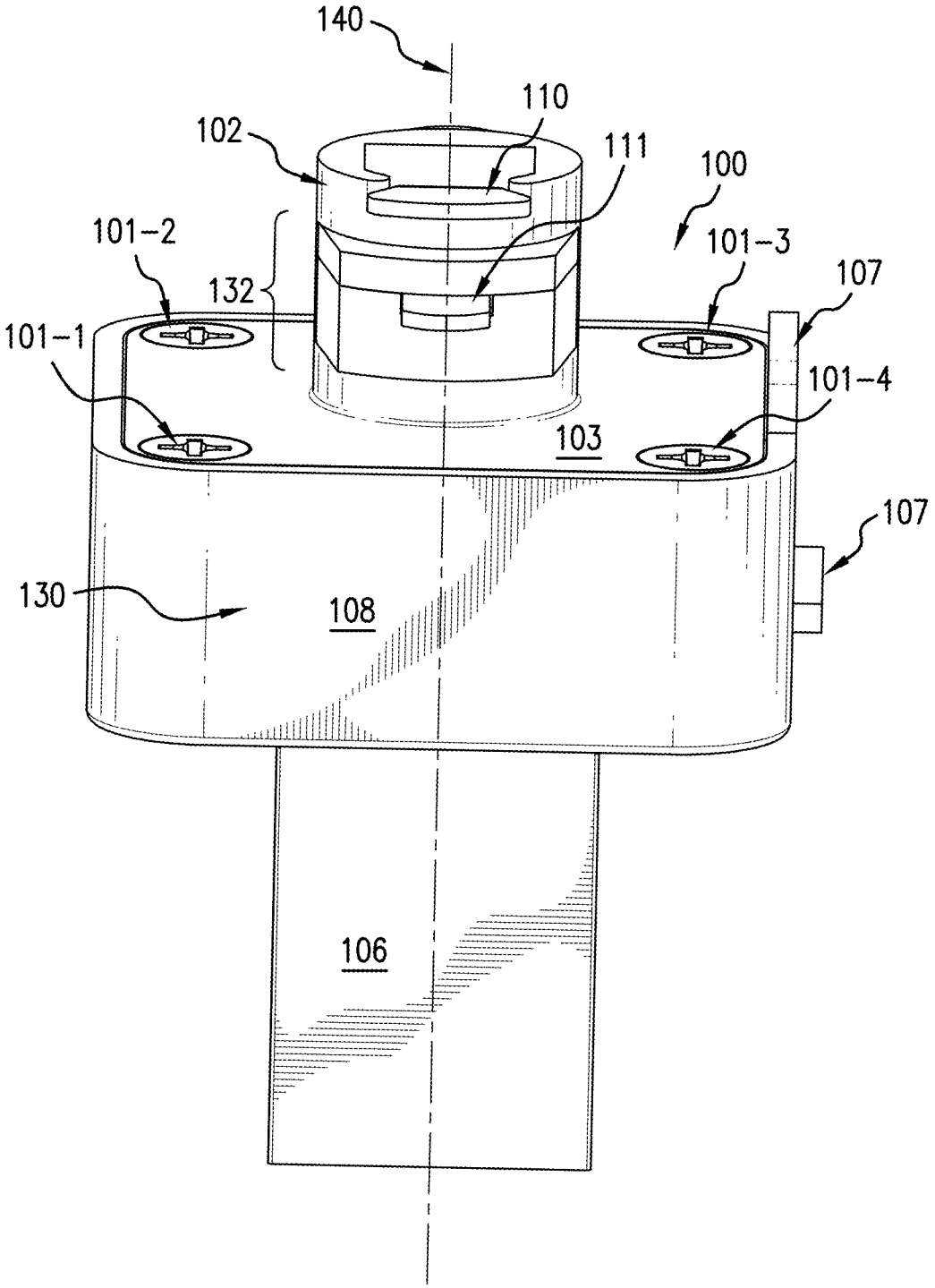
FIG. 1 illustrates a top-down perspective view of a left side of a portion of a low profile lighting adapter in accordance with the present disclosure.

For purposes of illustration, and not limitation, FIG. 1 illustrates a top-down perspective view of a left side 130 of a low profile lighting adapter 100 in accordance with the present disclosure. The low profile lighting adapter 100 includes a first housing section 102, configured with a cut out section to hold an electrical ground connection 110. The first housing section 102 can be inserted into a second housing section 103. The second housing section 103 can include a planar surface 131 and an extension 136 orthogonal to the planar surface 131 for coupling with the first housing section 102. The second housing section 103 also includes holes for receiving screws 101-1, 101-2, 101-3, and 101-4 (collectively referred to herein as screws 101). When coupled, the first housing section 102 and the second housing section 103 can hold neutral electrical connection 111. Housing 108 can encase the low profile lighting adapter 100, and connect with an extending arm 106. The extending arm 106 (shown in full in FIG. 9 and FIG. 10; partial views are otherwise displayed with the lower end of arm 106 truncated or cut) can be coupled to the housing 108 via a plurality of rings which enable extending arm 106 to rotate about an axis 140 orthogonal to planar surface 131. The low profile lighting adapter 100 can also include a clip 107 which can extend along axis 140 to lock low profile lighting adapter 100 into a fixed position, such as within a light track.

Figure 2:
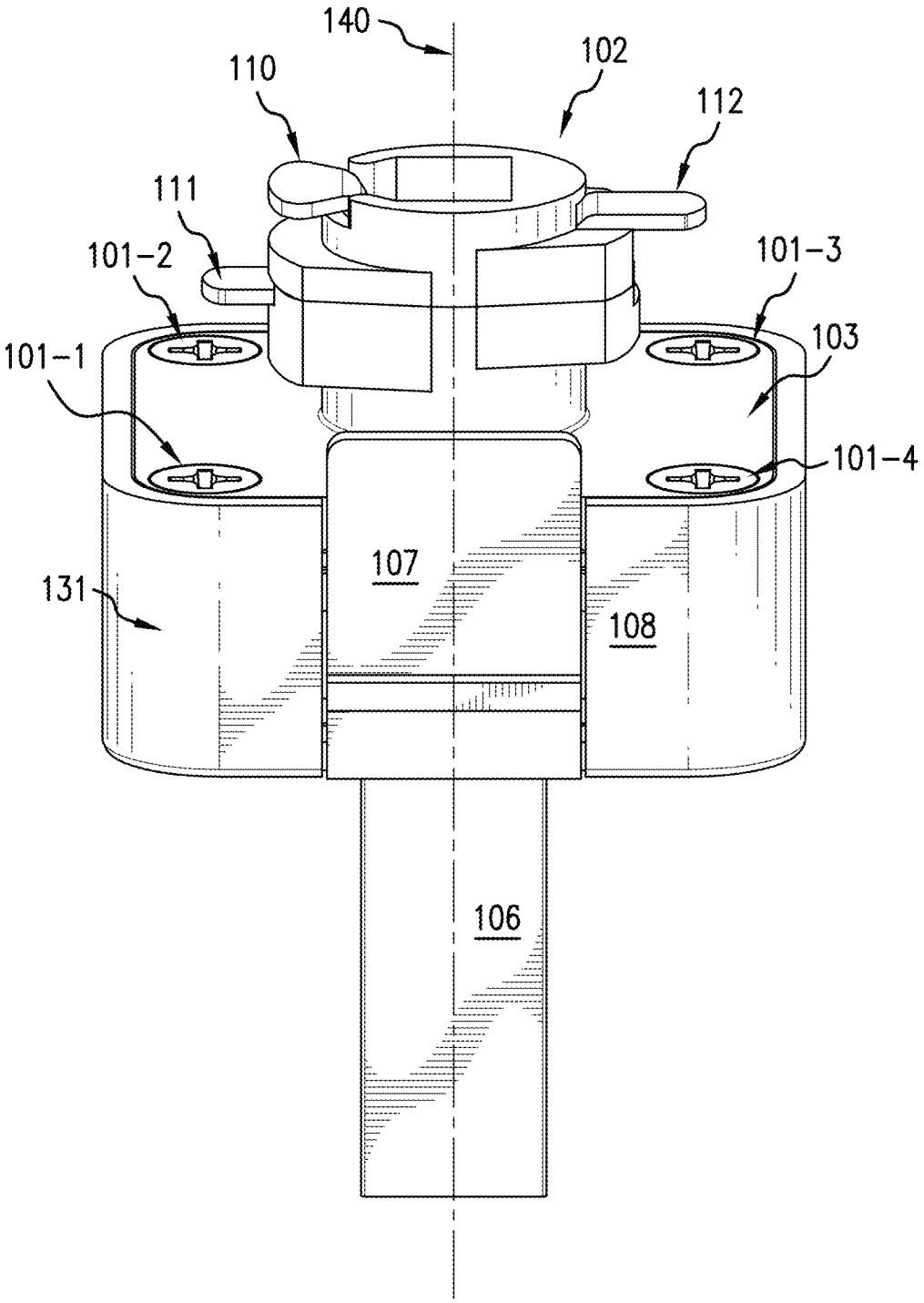
FIG. 2 illustrates a top-down perspective view of a front side of a portion of a low profile lighting adapter in accordance with the present disclosure.

FIG. 2 illustrates a top-down perspective view of a front side 131 of a low profile lighting adapter 100 in accordance with the present disclosure. The low profile lighting adapter 100 can include live electrical connection 112. The live electrical connection 112 can extend along axis 140 to connect with an electrical power supply, such as provided by a light track. The live electrical connection 112 can be individually actuated, or moved along axis 140, independent from conductive bracket 150 (shown, for example in FIG. 13C), the electrical ground connection no, and neutral electrical connection 111.

In a 2-circuit lighting adapter, one of the copper connectors can be set at two different levels. At one level, the copper connector makes electrical contact with a first electrical circuit on the light track, and the second level makes electrical contact with a second electrical circuit on the light track, thereby allowing two light switches to control two sets of lights on a single light track. In the example illustrated in FIG. 2, live electrical connection 112 can be actuated along axis 140 to one position in order to make electrical contact with a first electrical circuit on the light track, and actuate along axis 140 to a second position in order to make electrical contact with a second electrical circuit on the light track. That is, live electrical connection 112 can move to a distal position along axis 140 relative to conductive bracket 150 in order to make electrical contact with a first electrical circuit, and move to a proximal position along axis 140 relative to live bracket 150 in order to make electrical contact with a second electrical circuit. By individually actuating live electrical connection 112, a lower profile lighting adapter may be achieved because only one electrical component (e.g., live electrical connection 112) slides up or down to touch the upper or lower track.

Figure 3:
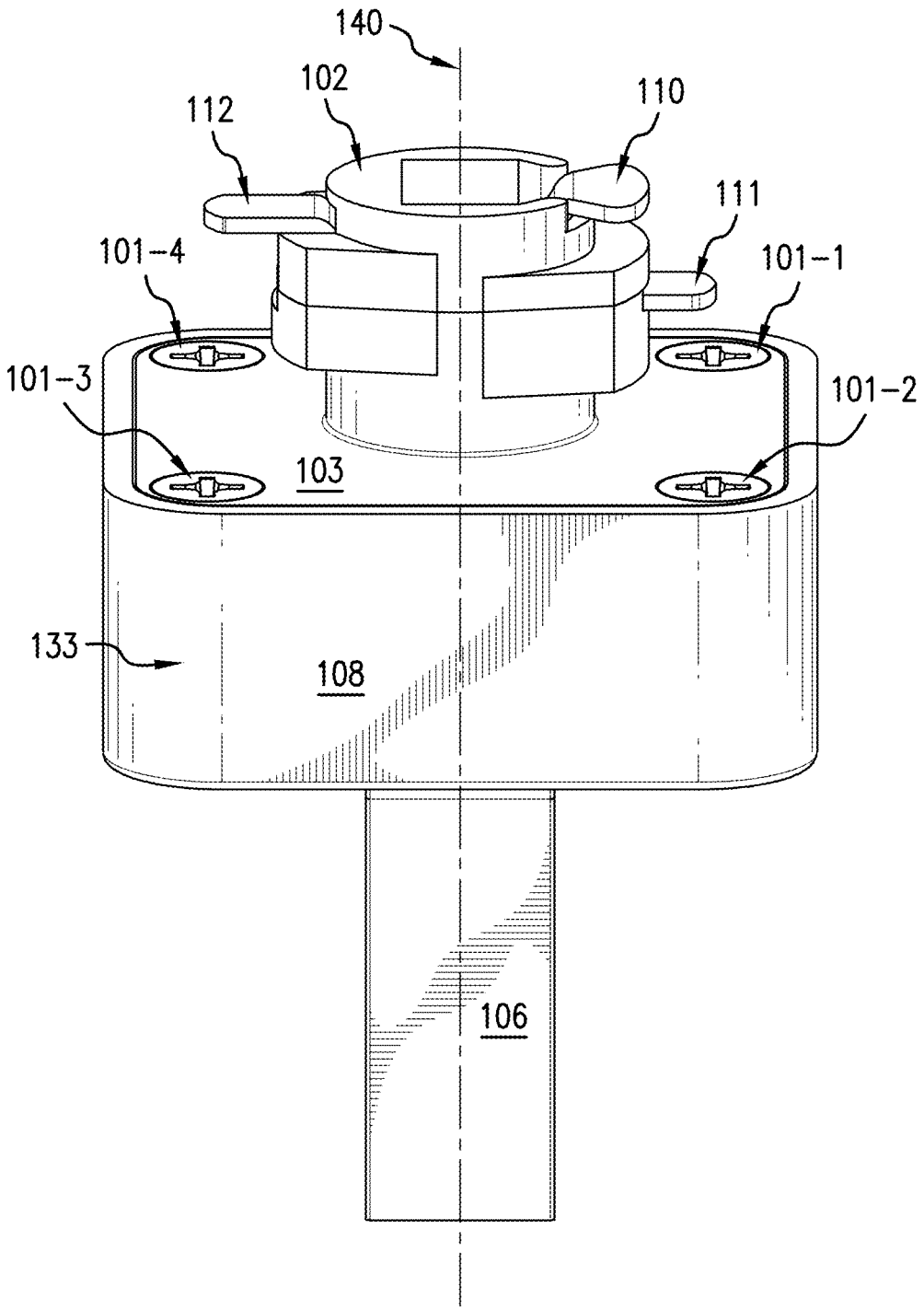
FIG. 3 illustrates a top-down perspective of a back side of a portion of a low profile lighting adapter in accordance with the present disclosure.
Figure 4:
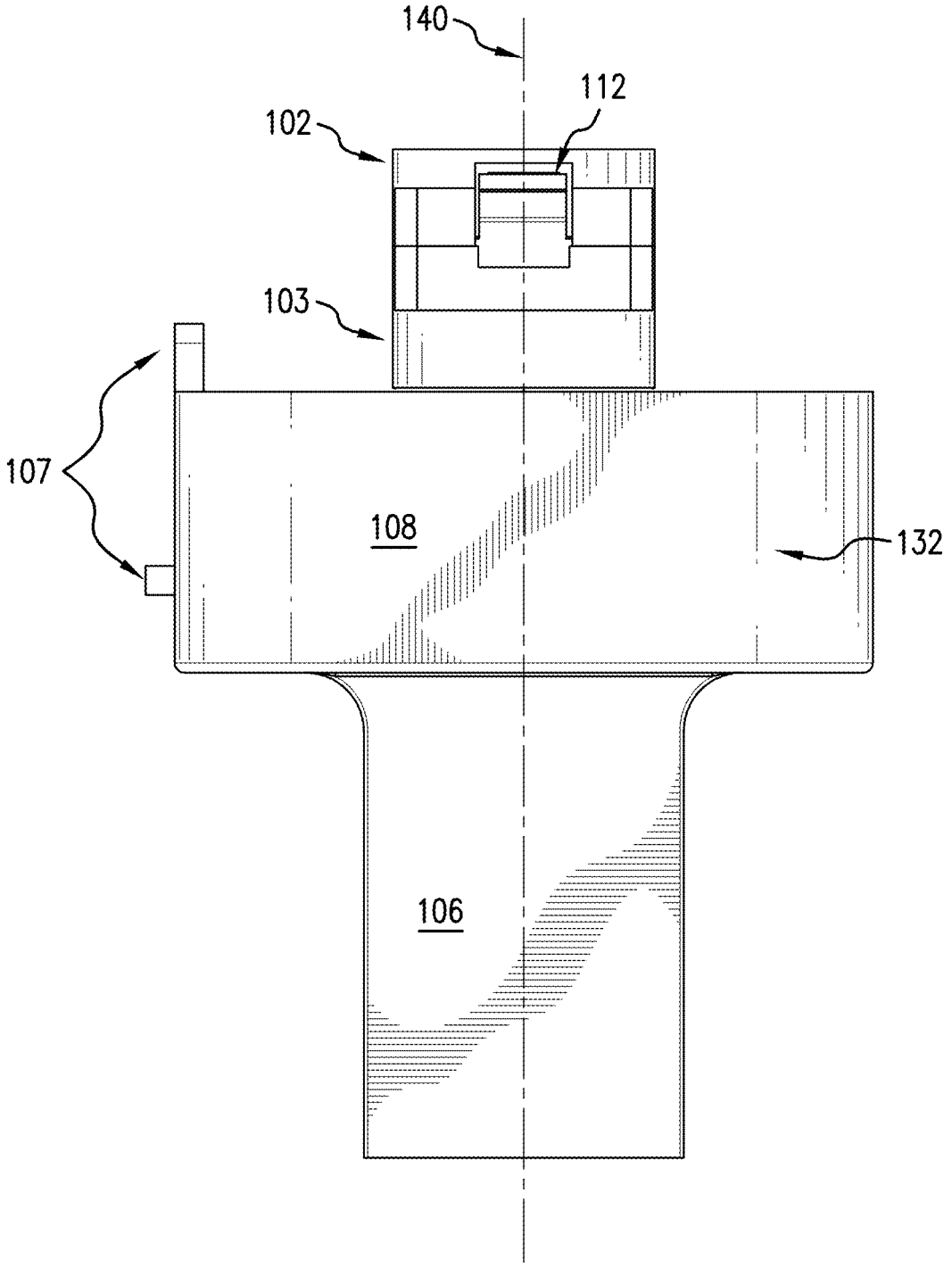
FIG. 4 illustrates a side perspective of a right side of a portion of a low profile lighting adapter in accordance with the present disclosure.
Figure 5:
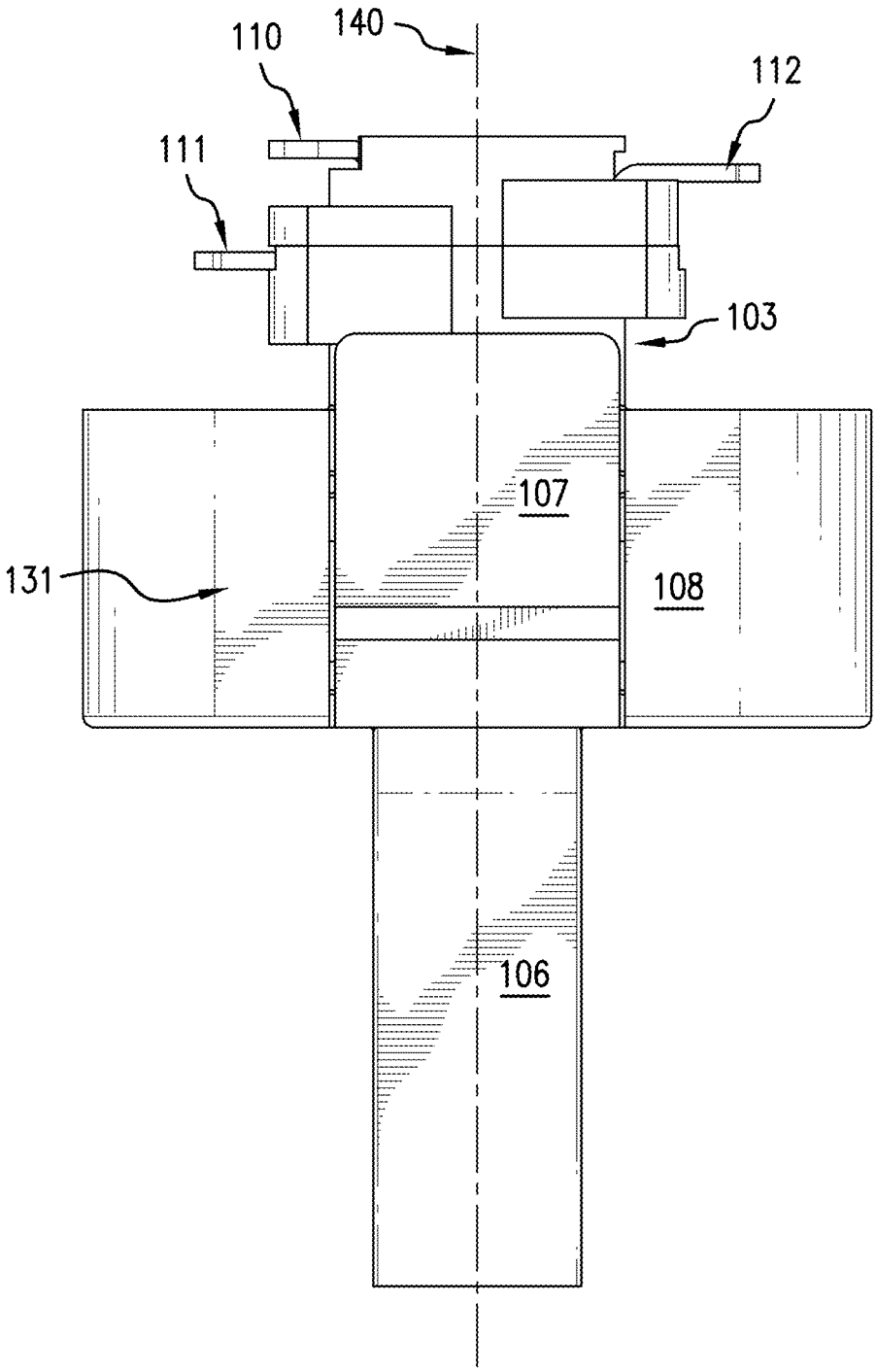
FIG. 5 illustrates a side perspective of a front side of a portion of a low profile lighting adapter in accordance with the present disclosure.

FIG. 3 illustrates a top-down perspective of a back side 133 of a low profile lighting adapter 100, and FIG. 4 illustrates a side perspective of a right side 132 of the low profile lighting adapter 100. As illustrated in FIG. 4, the first housing section 102 and/or the second housing section 103 can include a cut out portion, or channel, which permits the live lead 112 to slide along axis 140 with respect to bracket 150, and independently from electrical ground connection 110, and neutral electrical connection 111. FIG. 5 illustrates a side perspective of a front side 131 of the low profile lighting adapter 100. Because live electrical lead 112 can move along axis 140 independently from bracket 150, electrical ground connection 110, and neutral electrical connection 111, the low profile lighting adapter 100 can have a lower height form factor as compared to lighting adapters in which multiple electrical connections actuate along a longitudinal axis. Bracket can be bowed in an outward radial direction away from the center of the assembly and directly contact housing 102 at each end as set forth in FIG. 22B so as to act as a leaf spring that can deflect downwardly/radially inwardly, as lead 112 slides over it within the outer axial channel of housing 102.

Figure 6:
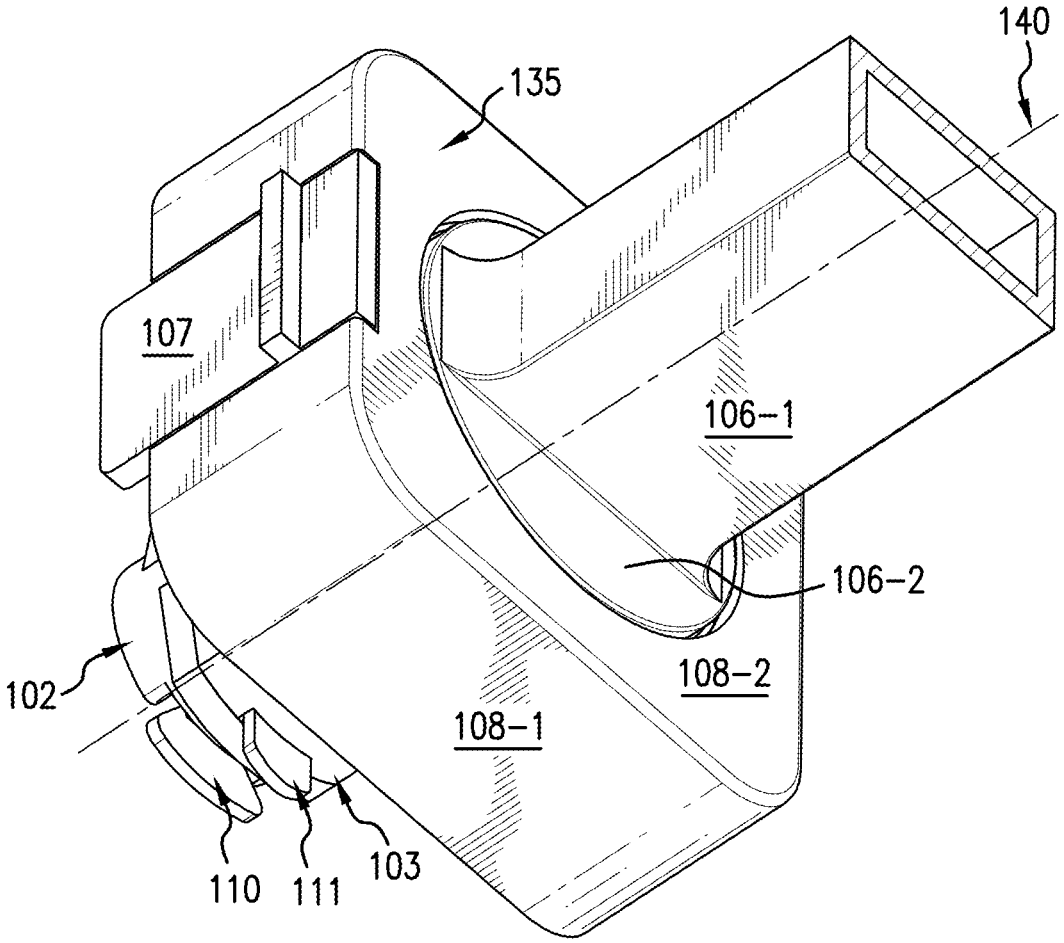
FIG. 6 illustrates a bottom-up perspective of a portion of a low profile lighting adapter in accordance with the present disclosure.
Figure 7:
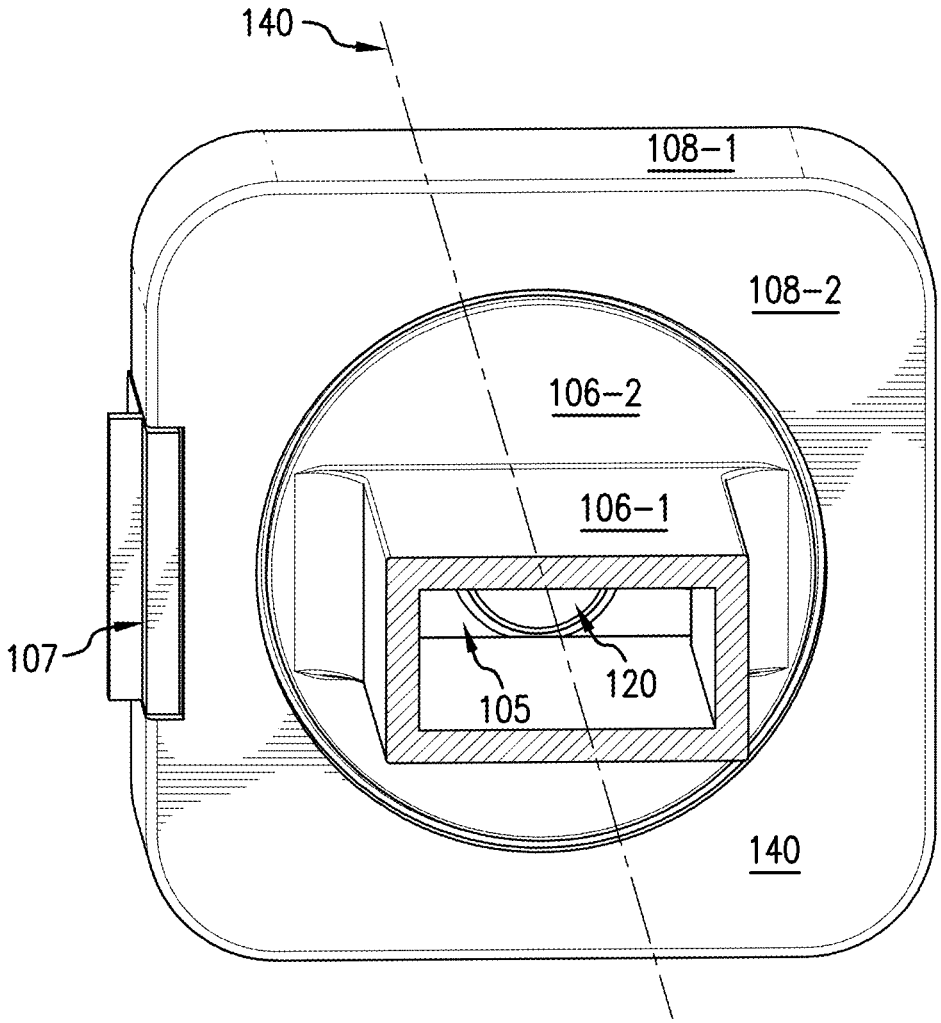
FIG. 7 illustrates an additional bottom-up perspective of a portion of a low profile lighting adapter in accordance with the present disclosure.
Figure 8:
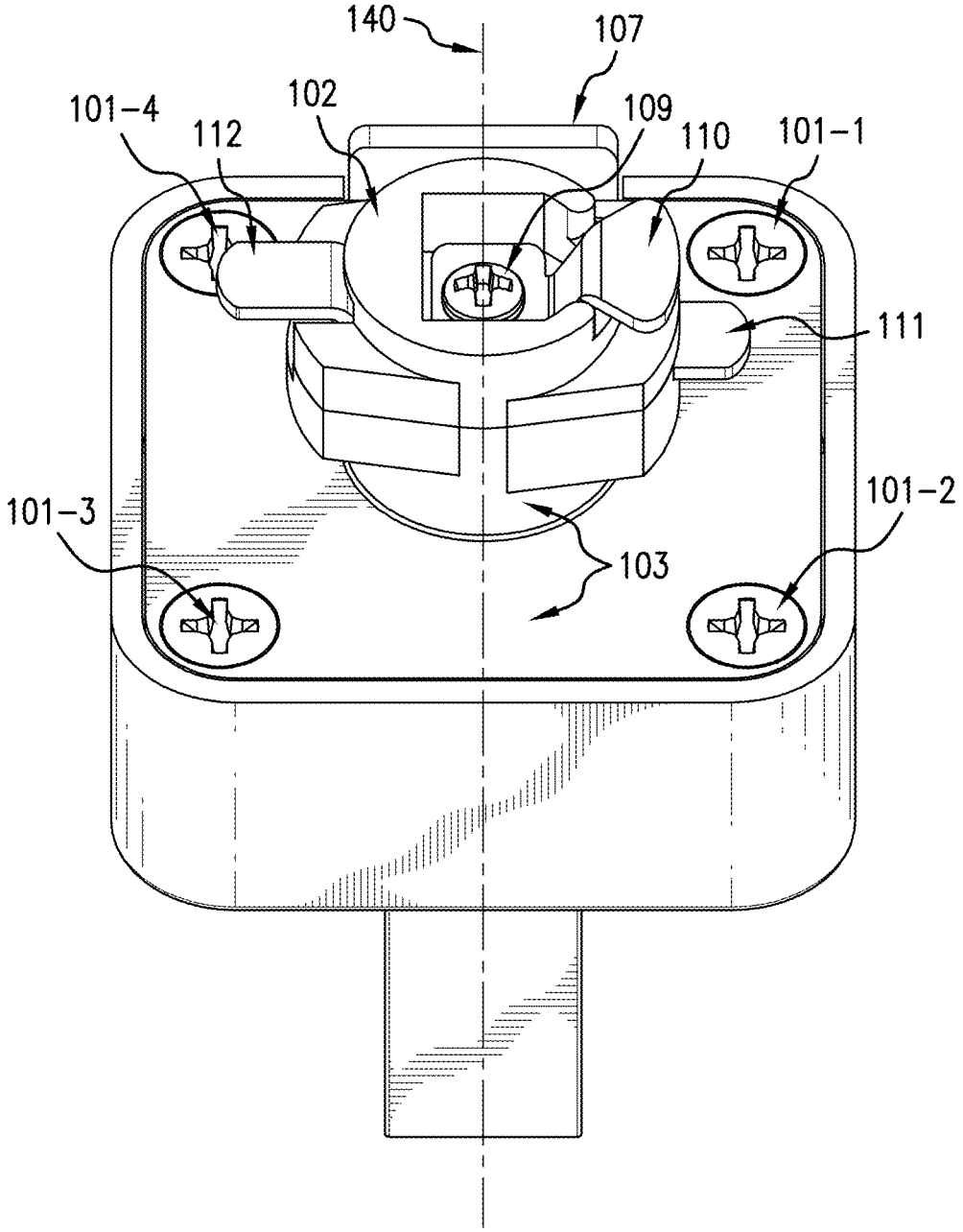
FIG. 8 illustrates an additional top-down perspective of a portion of a back side of a low profile lighting adapter in accordance with the present disclosure.

FIG. 6 illustrates a bottom-up perspective of a low profile lighting adapter 100 in accordance with the present disclosure. As illustrated, housing 108 can include a bottom portion 108-2 that is disposed along a planar surface 135 and a side portion 108-1 which encompasses the low profile lighting adapter 100 in a direction orthogonal to planar surface 135. Similarly, extending arm 106 can include a first portion 106-1 which extends along axis 140, and a second portion 106-2 orthogonal to portion 106-1 and configured to rotate in 360 degrees about axis 140 and within housing 108-2. As illustrated, extending arm 106 may have a hollow core and may have a generally rectangular or other shape (e.g., cylindrical or other desired shape). As illustrated in FIG. 7, the extending arm 106 may be coupled to a bottom holder 105 via a ground bolt 120. Ground bolt 120 extends a length of the housing 108, to facilitate coupling of housing 108 to the second housing section 103, via a top plate (discussed further herein). FIG. 8 illustrates an additional top-down view of the low profile lighting adapter 100. As illustrated in FIG. 8, live electrical connection 112 is disposed above bracket 150 along axis 140 and relative to the extended arm 106. The live electrical connection 112 is configured to be actuated up and down (prior to or during installation) along axis 140, in order to make electrical contact with different electrical circuits, as described herein. Because live electrical connection 112 actuates along axis 140 independently of live conductive bracket 150, a lower profile lighting adapter 100 can be achieved. Ground screw 109 connects the top of the lighting adapter to ground bolt 120, so as to hold the fully assembled lighting adapter together.

Figure 9:
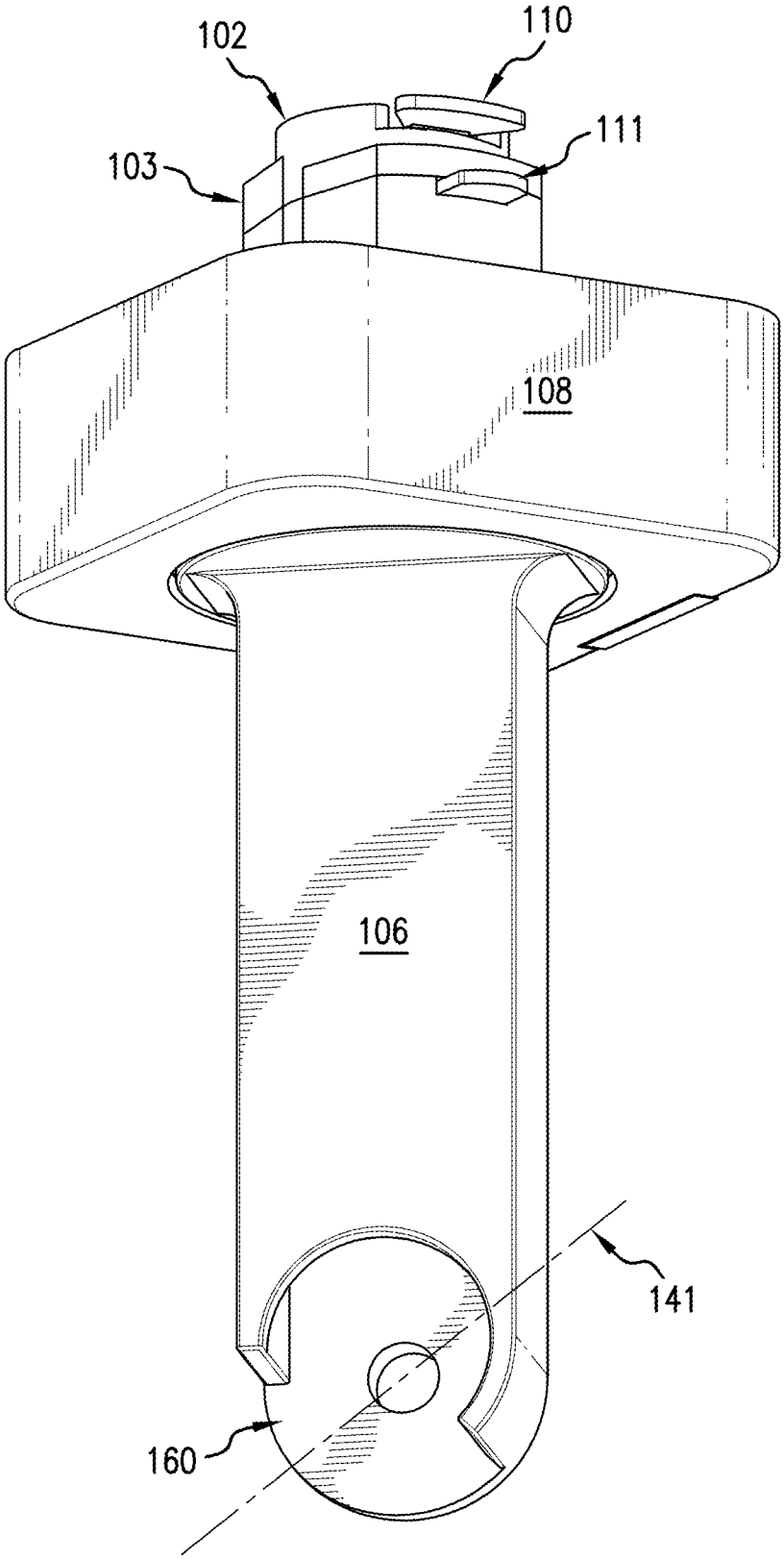
FIG. 9 illustrates a bottom-up view of a low profile lighting adapter illustrating an extended arm in accordance with the present disclosure.
Figure 10:
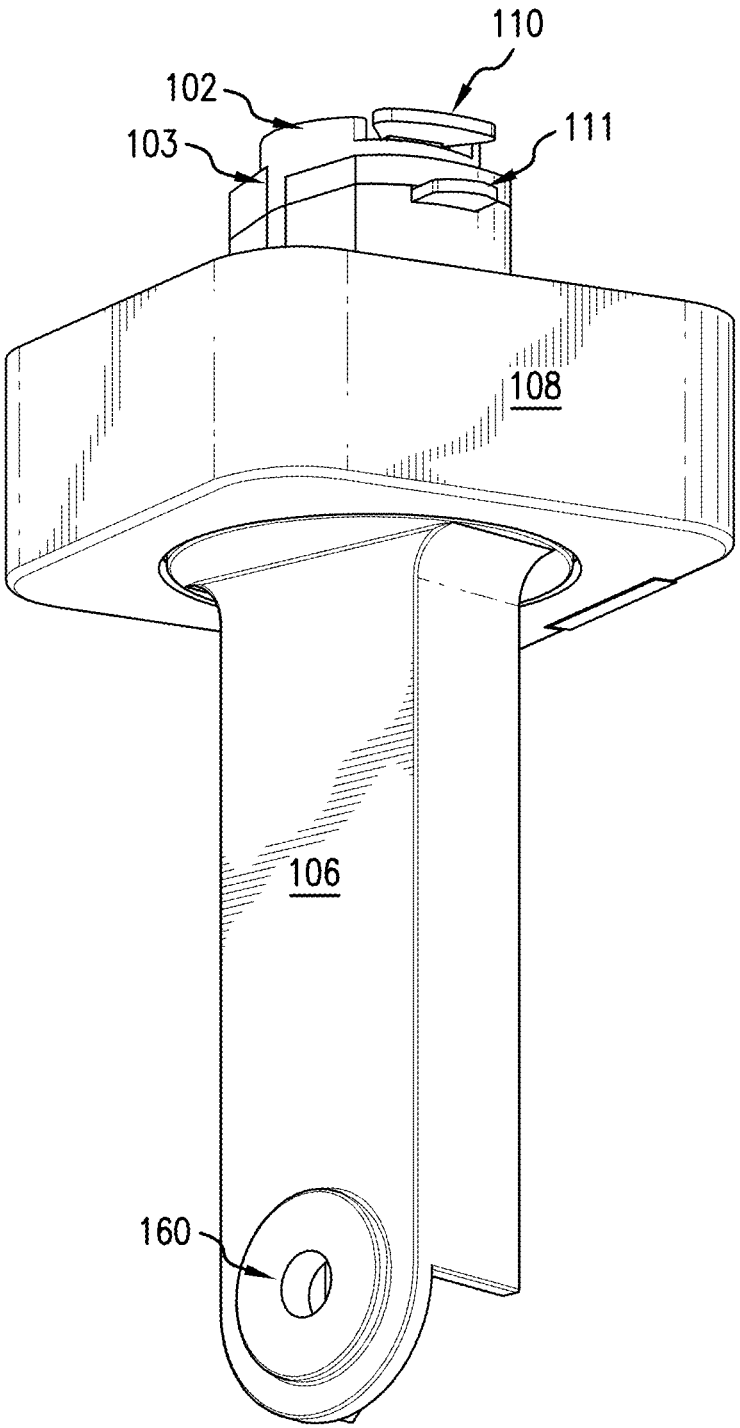
FIG. 10 illustrates a bottom-up view of a low profile lighting adapter with an extended arm in accordance with the present disclosure.

FIGS. 9 and 10 illustrate a bottom-up view of a low profile lighting adapter 100 with an extended arm 106 in accordance with the present disclosure. As illustrated, the extended arm 106 can include a depression 160 configured to receive an apparatus, such as a lighting fixture. Although the depression 160 is illustrated as having a generally circular shape with a hollow center, examples are not so limited and the depression 160 may have different shapes. FIG. 9 illustrates a front view of the depression 160, whereas FIG. 10 illustrates a back view of the depression 160. As described herein, the extended arm 106, including the depression 160, can rotate about an axis (140 illustrated in FIGS. 1 through 8). The depression 160 can be configured to allow an attached apparatus to rotate about a second axis 141 (illustrated in FIG. 9).

Figure 11:
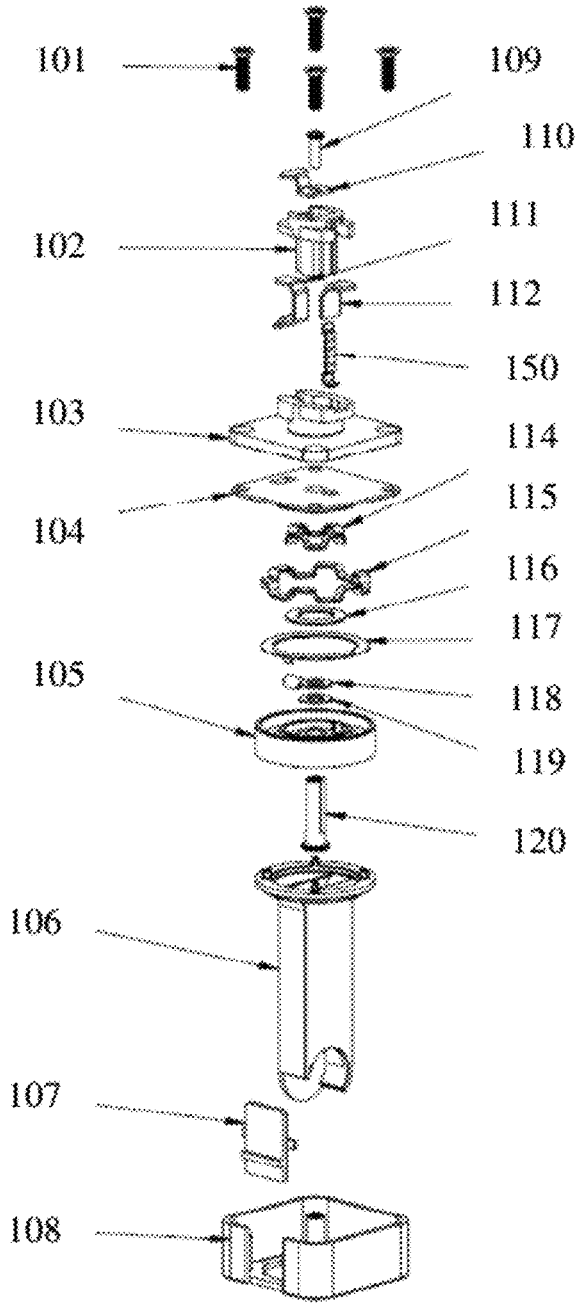
FIG. 11 illustrates an exploded view of a low profile lighting adapter with an extended arm in accordance with the present disclosure.

FIG. 11 illustrates an exploded view of the low profile lighting adapter 100 with an extended arm in accordance with the present disclosure. While the table in FIG. 11 provides various example materials for the various components illustrated, examples of the present disclosure are not limited to the materials listed. Also, while FIG. 11 illustrates a first live electrical connection 112, preferred embodiments include a second live electrical connection disposed below live electrical connection 112. The second live electrical connection (not illustrated) is stationary, and does not actuate as described herein. However, live electrical connection 12 extends along axis 140 via along bracket 150 in order to make electrical contact with a distal electrical circuit.

Figure 21A:
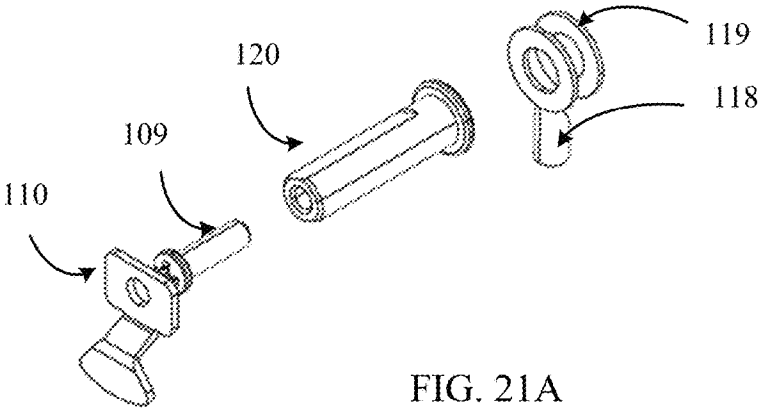
FIGS. 21A-21B illustrate various views of the ground conductors in the illustrated embodiment.
Figure 21B:
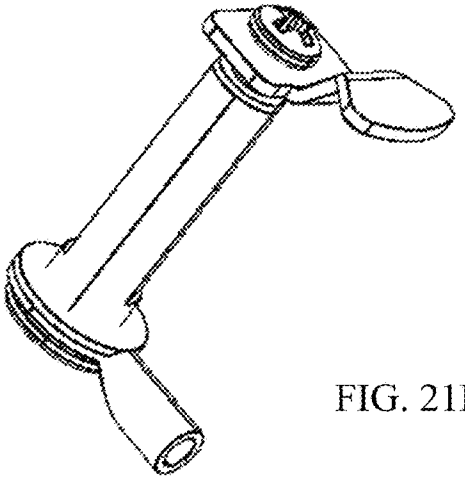

As further illustrated in FIG. 11, screws 101 hold the assembly together. Housing section 102 defines a channel therein for receipt of various electrical contacts, as well as a track for accommodating the combination of spring-like conductor bracket 150 and live lead contact 112. Ground connection 110 completes a ground circuit path through other ground components ground bolt 120, ground screw 109, ground ring 118 (for connection to a lighting device or other accessory by a further conductor (not shown)) and washer 119, shown in further detail in FIGS. 21A-21B, showing exploded and collapsed views, respectively, of the ground circuit path assembly.

Figure 19A:
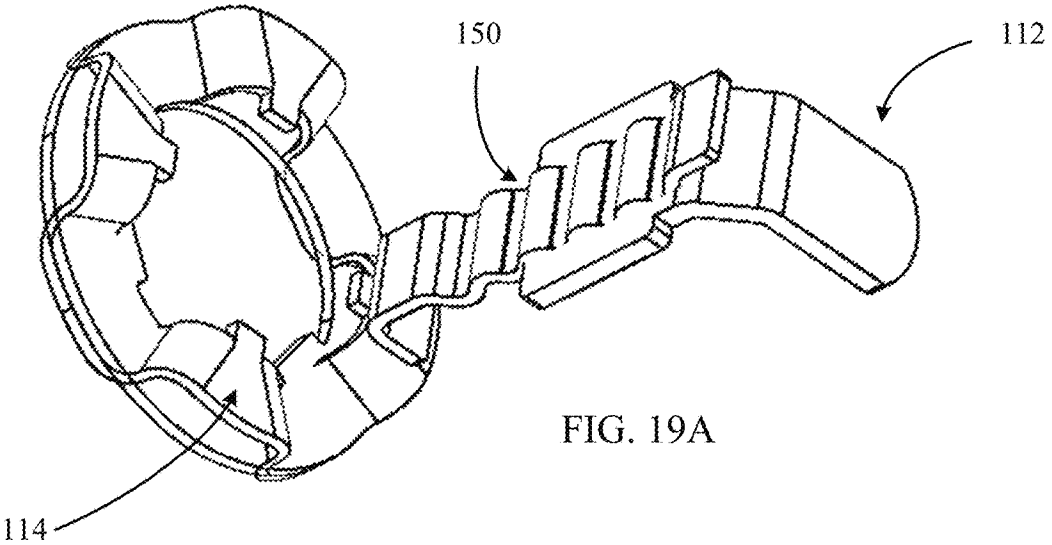
FIGS. 19A-19C illustrate various views of the live conductors in the illustrated embodiment.
Figure 19B:
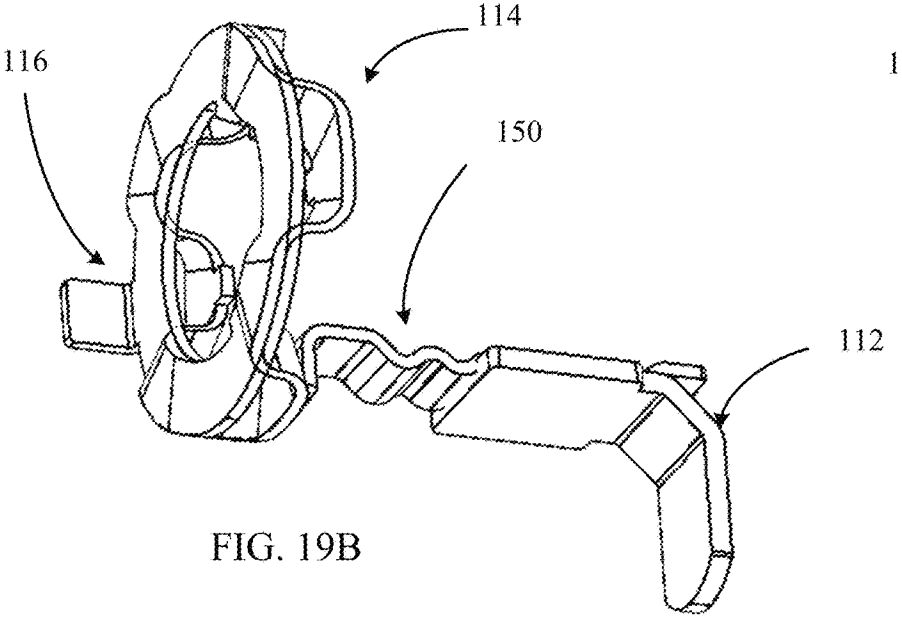
Figure 19C:
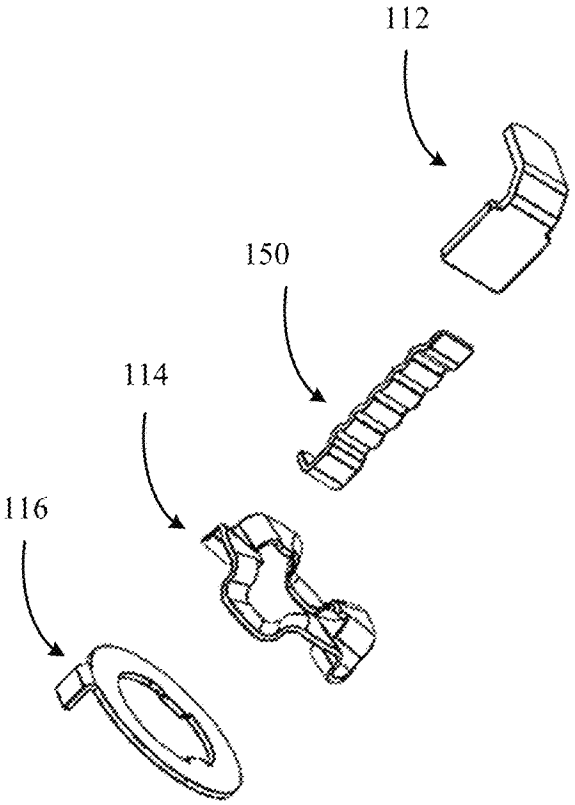
Figure 22A:
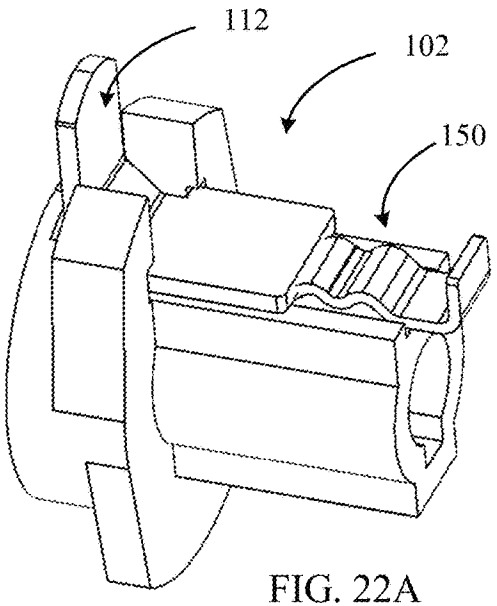
FIGS. 22A-22B illustrate isometric and cross sectional views, respectively, of a housing portion of the illustrated embodiment showing placement of live conductor components therein.
Figure 22B:
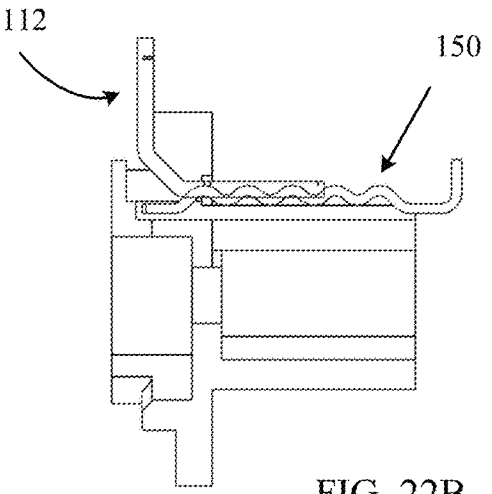

FIG. 11 also shows components of the live circuit path for connecting a hot lead to a lighting device or other accessory that includes live connection lead 112 that is generally L-shaped, which is in sliding frictional engagement with undulating bracket 150 along one portion of the L, wherein the end of the live lead 112 slides along bracket 150. Bracket 150 is received within a channel of housing portion 102 as illustrated in FIGS. 13C, and 22A and 22B, wherein 22B is a cross section showing bracket beneath lead 112. The drawings suggest an overlap between the two components, but they are intended to be separate, and relatively slidable. A distal end 153 of bracket 150 is in sliding contact with radially inner conductive wave ring 114 that in turn rests on top of conductive ring 116. Wave ring 114 can be compressed to a predetermined extent in the assembly in order to achieve a desired contact force or stress in the ring 114 and/or to help control the amount of friction resisting rotation in the assembly to help in aiming the lighting device when it is installed in a track. Conductive ring 116 can then in turn be connected to a lighting device (or driver therefor) or other accessory by a further conductor (not shown). Various views of these components can also be seen in FIGS. 19A-19C, wherein 19C is an exploded view, and the other views show clear relative placement of the components.

Figure 18C:
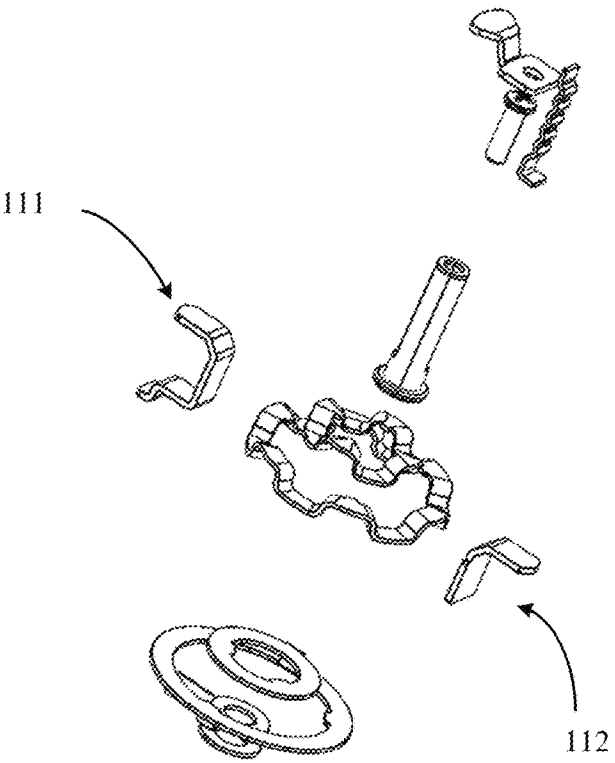
FIGS. 18A-18C illustrate various views of the conductors in the illustrated embodiment.
Figure 18B:
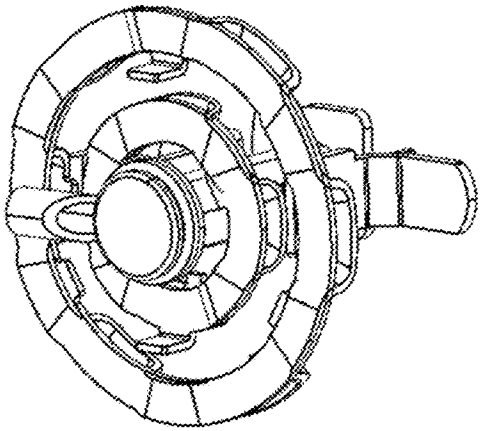
Figure 18A:
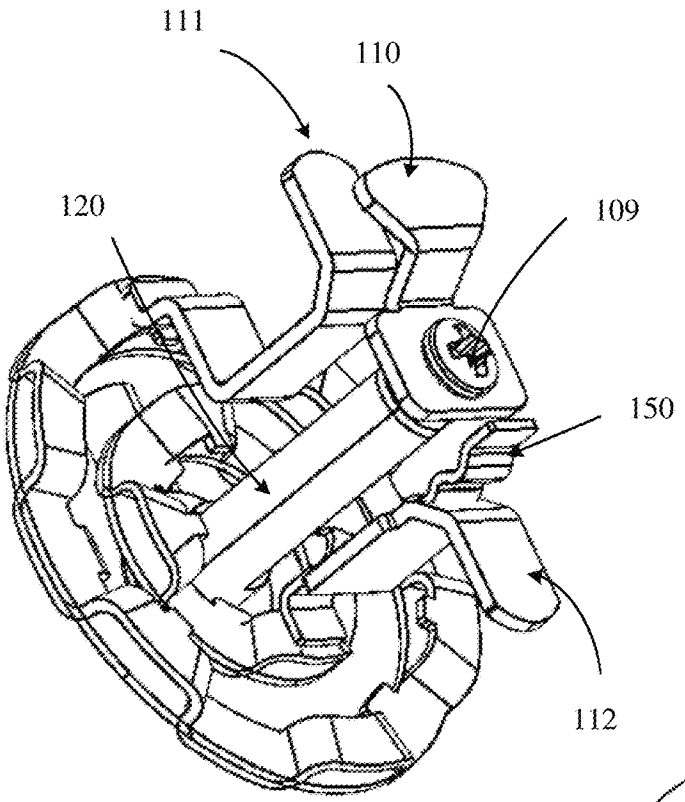
Figure 20C:
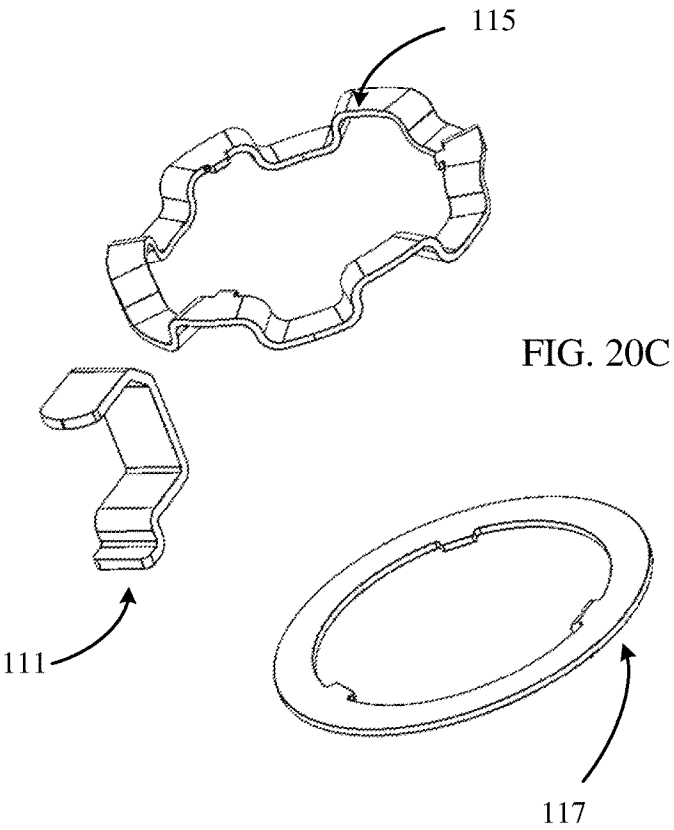
FIGS. 20A-20C illustrate various views of the neutral conductors in the illustrated embodiment.
Figure 20A:
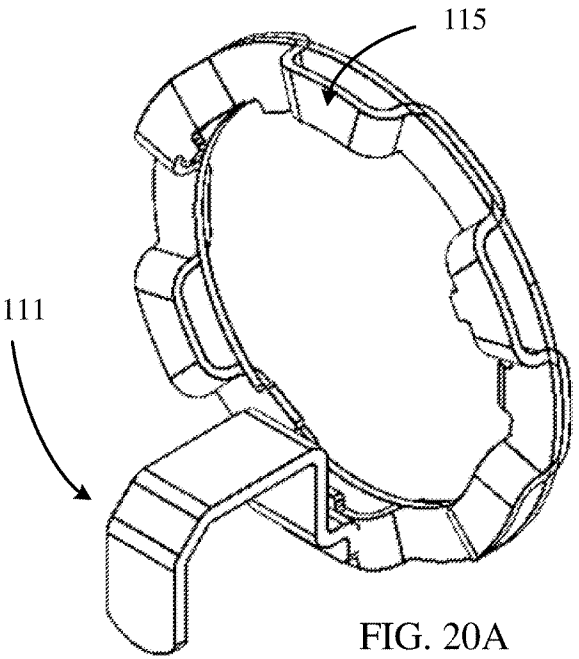
Figure 20B:
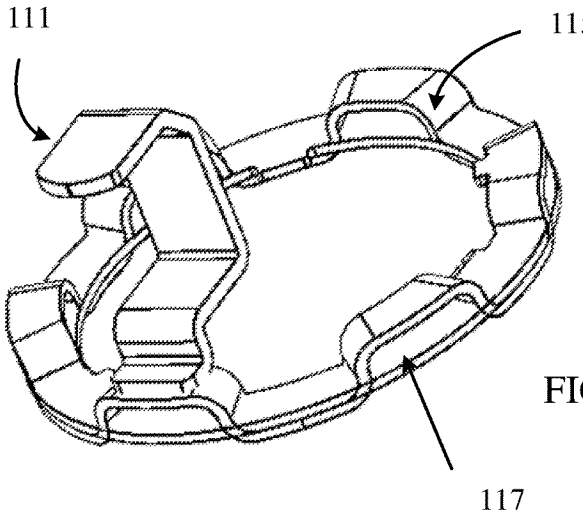

FIG. 11 also shows components of the neutral circuit path for connecting a neutral lead to a lighting device or other accessory. Neutral circuit path includes neutral lead 111 that is generally C shaped and has a lower, or distal, foot that is in sliding contact with outer wave ring 115 that is disposed radially outwardly with respect to ring 114. Ring 115 rests atop conductive ring 117 that can be electrically coupled to a lighting device (or driver therefor) or other accessory by a further conductor (not shown). Various views of these components can also be seen in FIGS. 20A-20C, wherein 20C is an exploded view, and the other views show clear relative placement of the components. FIGS. 18A-18C show relative placements of the conductors forming the hot, neutral, and ground circuit paths with the remainder of the device removed for illustration purposes.

FIG. 11 also shows plate component 103 that is received by housing 108. Housing 108 receives yoke or arm 106 therein, atop which rests the aforementioned electrical components. Plate 104 is also provided for maintaining relative conductor spacing, as well as inner bracket 105. Lock clip 107 is also provided, described elsewhere herein.

Figure 12B:
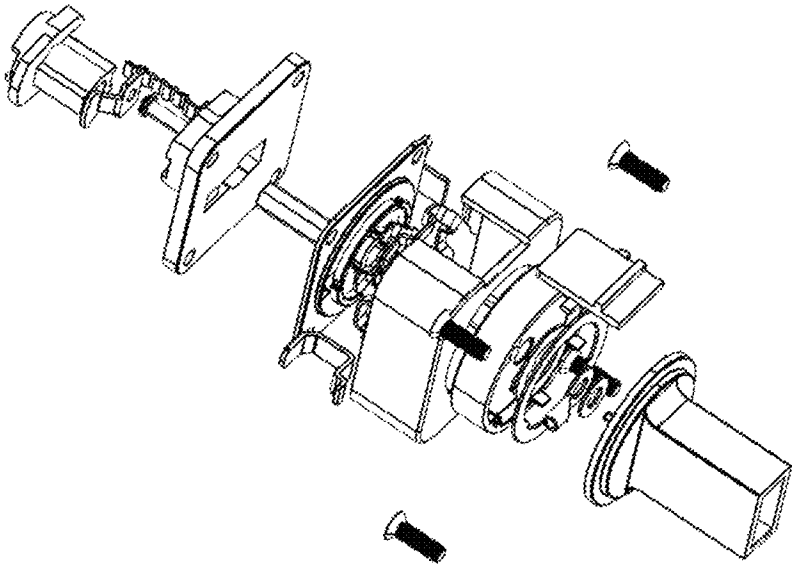
FIGS. 12A and 12B illustrate additional exploded views of the low profile lighting adapter 100 in accordance with the present disclosure.
Figure 12A:
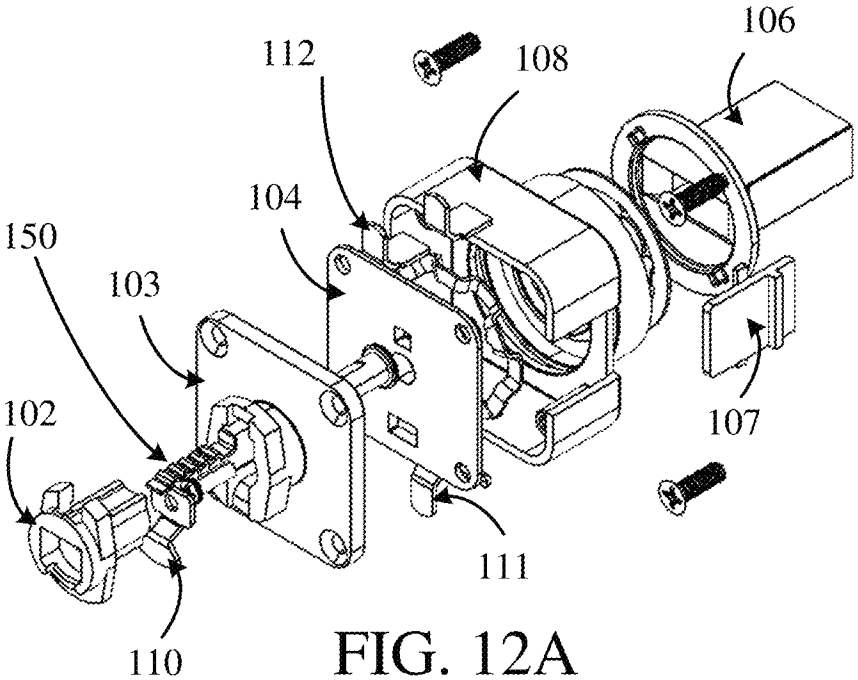

FIGS. 12A and 12B illustrate additional exploded views of the low profile lighting adapter Dm in accordance with the present disclosure. As illustrated in FIG. 12A, the housing 108 includes side walls to contain the plurality of rings, which enable the bottom holder or inner bracket 105 to rotate about the central axis of the low profile lighting adapter in 180 degrees. The extending arm 106 is coupled to the bottom holder 105, thereby facilitating rotation of the extending arm 106 about the central axis of the low profile lighting adapter in 180 degrees. The plurality of rings are further protected by top plate 104. The top plate 104 is configured to fit within housing 108 and couple to the second housing section 103 via the plurality of screws 101. To enable a low-profile design, the second housing section 103 includes a central opening that is configured to receive the first housing section 102. The first housing section 102 further includes a depression, or channel, configured to receive conductive bracket 150, shown in cross section in FIG. 22B.

Figure 13A:
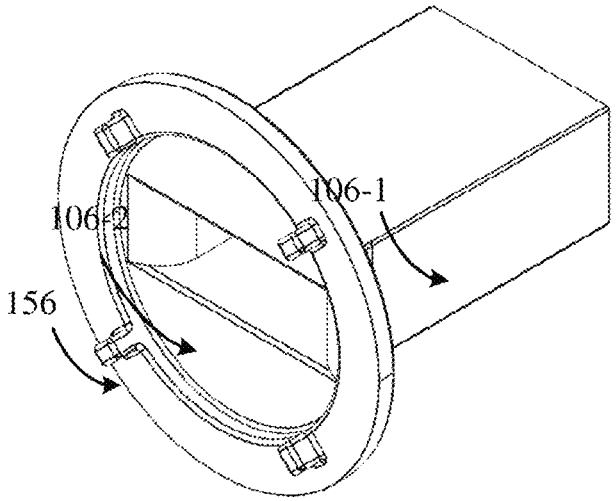
FIGS. 13A and 13B illustrate different perspective views of the extending arm.
Figure 13B:
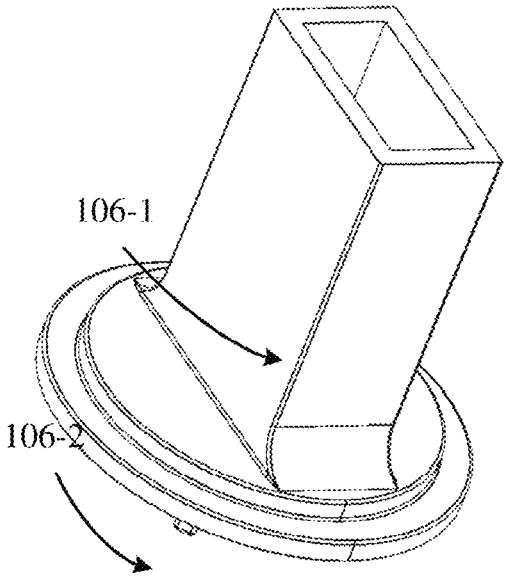
Figure 13C:
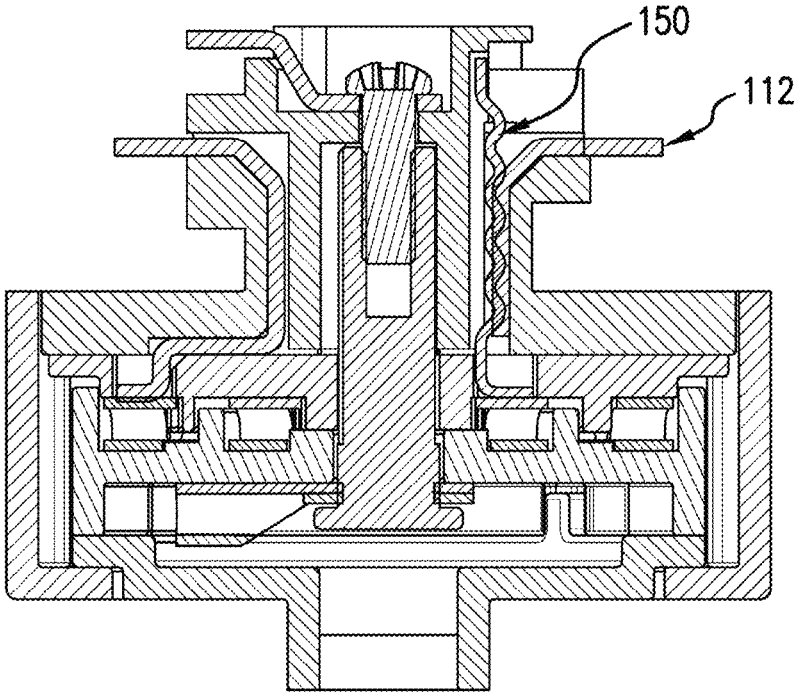
FIG. 13C illustrates a cross section of an illustrative embodiment.

FIGS. 13A and 13B illustrate different perspective views of the extending arm 106. As discussed with regard to FIGS. 6 and 7, the extending arm includes a first portion 106-1 and a second portion 106-2. The second portion 106-2 can have a generally circular shape, thereby enabling extending arm 106 to rotate within the housing of the low-profile lighting adapter. Additionally, the second portion 106-2 can include projections 156, such as those illustrated on the side opposite of first portion 106-1, to seat the extending arm 106 against the bottom holder 105 (as discussed with regard to FIG. 15). While the first portion 106-1 is illustrated as having a generally rectangular shape, as illustrated in FIGS. 9 and 10, the first portion 106-1 can include a depression configured to receive an apparatus, such as a lighting fixture. It will be appreciated that the extending arm can have any desired length, and any desired cross sectional shape (e.g., rectangular, oval, circular, etc.).

Figures 14A, 14B, 14C, 14D, 14E, 14F, 14G, 14H, 14I, 14J, 14K, 14L:
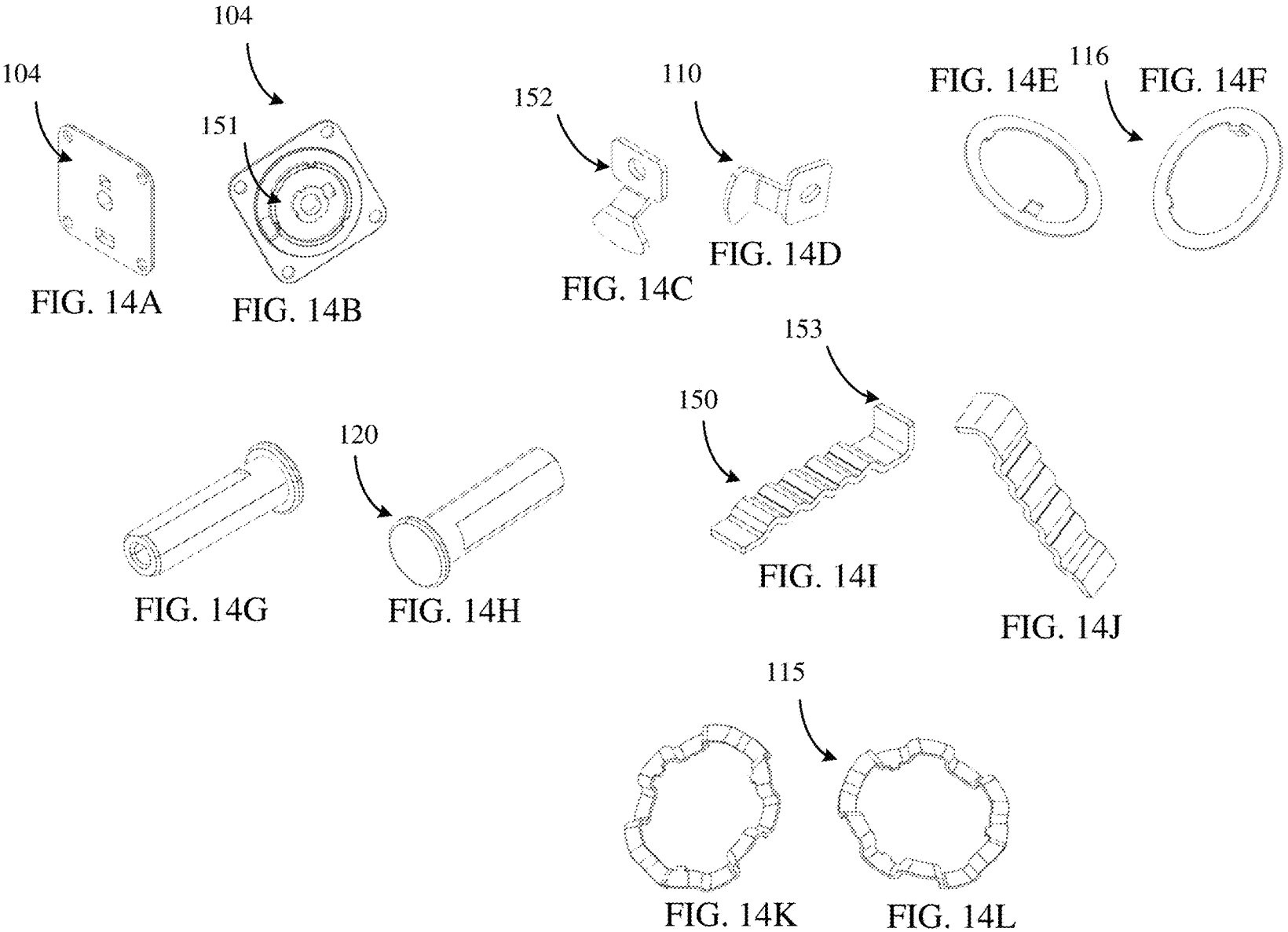
FIGS. 14A-14L illustrate expanded views of various components of the low profile lighting adapter described herein.

FIGS. 14A-14L illustrate expanded views of various components of the low profile lighting adapter 100 described herein. For example, FIG. 14A illustrates a top-down view of top plate 104, whereas FIG. 14B illustrates a bottom-up view of top plate 104. The top plate 104 includes screw holes such that the top plate is coupled with the external housing (e.g., 108 illustrated in FIG. 1) and a second housing section (e.g., 103 illustrated in FIG. 1). The top plate 104 also includes a central hole 151 configured to receive a ground bolt, illustrated in FIGS. 14G and 14H. FIGS. 14C and 14D illustrate expanded views of electrical ground connection 110 from a top-down perspective and a bottom-up perspective, respectively. As illustrated, the electrical ground connection 110 includes a central hole 152 configured to receive a ground screw, such as item 9 illustrated in FIG. 11. FIGS. 14E and 14F illustrate bottom-up and top-down perspective views (respectively) of a first ring configured to enable rotation of the extended arm 106, such as that illustrated as item 17 in FIG. 11. The first ring can include a plurality of orthogonal tabs that are configured to seat the ring within a bottom holder, such as within item 5 illustrated in FIG. 11. FIGS. 141 and 14J illustrate expanded views of a bracket 150 configured to actuate a live electrical connection, such as described with reference to FIGS. 12A and 12B. As described therein, the bracket 150 can be a dead electrical connection, and can include a plurality of lateral depressions. Moreover, the bracket 150 includes a laterally extending tab, or distal foot, 153, which facilitates movement of the live electrical connection (e.g., 112 illustrated and described in FIG. 2) to actuate along a central axis (e.g., axis 140 illustrated and described in FIG. 2). FIGS. 14K and 14L illustrate bottom-up and top-down perspective views (respectively) of a second ring configured to enable rotation of the extended arm 106, such as that illustrated as item 115 in FIG. 11. As can be seen in FIG. 11, preferred embodiments of the low profile lighting adapter 100 include a plurality of rings (e.g., items 114-118) arranged in a layered pattern to facilitate rotation of the extended arm 106.

FIGS. 15A-15H illustrate various expanded views of various components of the low profile lighting adapter 100 described herein. FIG. 15A illustrates a top-down perspective view of the bottom holder (e.g., 105 illustrated in FIG. 7 and bracket 105 illustrated in FIG. 11). FIG. 15B illustrates another top-down perspective view of the bottom holder, and FIG. 15C illustrates a bottom-up perspective view of the bottom holder. As illustrated, the bottom holder includes a series of concentric circular depressions configured to receive a plurality of rings (illustrated and described with regard to FIG. 16) which enable rotation of the extending arm 106 as described herein. Moreover, the bottom holder includes a central hole 154 configured to receive a ground bolt 120, so as to couple the bottom holder to a top portion of the low profile lighting adapter (e.g., via the second housing section 103 and top plate 104). FIG. 15C illustrates a bottom-up view of the bottom holder, which is configured to receive the extending arm 106. As illustrated, the bottom holder includes a plurality of notches 155 configured to receive projections on the extending arm 106 (e.g., 156 illustrated in FIG. 13A), thereby securing the extending arm 106 to the bottom holder. FIGS. 15D and 15F illustrate top-down perspective views of the housing 108, and FIG. 15E illustrates a bottom-up perspective view of the housing 108. As illustrated, the housing 108 includes an indentation 157 configured to receive lock clip 107 illustrated in FIGS. 15G and 15H, as well as a central hole 158 configured to receive the extending arm 106, as described herein. The housing further includes screw holes to couple the housing to a top portion, such as second housing section 103 and top plate 104 illustrated in FIG. 12A. The lock clip illustrated in FIGS. 15G and 15H includes a plurality of tabs, 159-1 and 159-2. Tabs 159-1 and 159-2 extend along a length of the lock clip. Tab 159-1 is configured to extend laterally beyond the width of the lock clip 107 to seat the lock clip within the housing illustrated in FIGS. 15D-F. Tab 159-2 is configured to extend along an outer edge of the housing, such that a user may apply a force to actuate the lock clip, such as along axis 140 illustrated in FIG. 2.

Figure 16A:
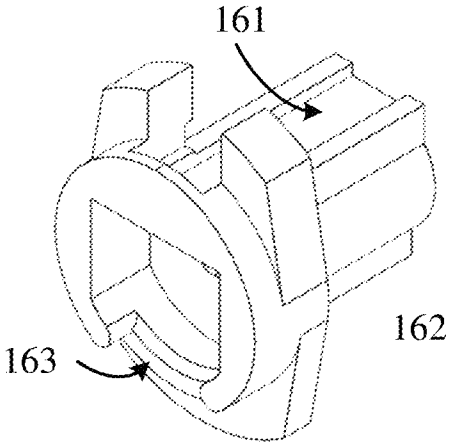
FIGS. 16A-16F illustrate various expanded views of further components of the low profile lighting adapter described herein.
Figure 16B:
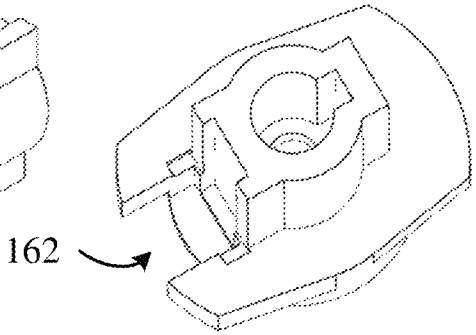
Figure 16C:
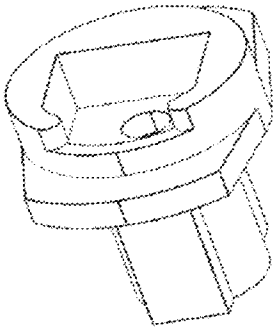
Figure 16D:
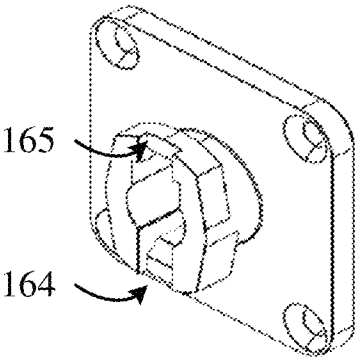
Figure 16E:
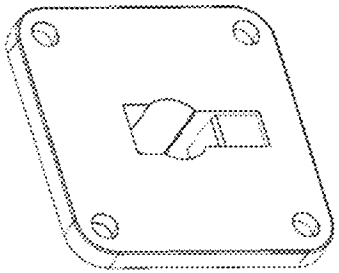
Figure 16F:
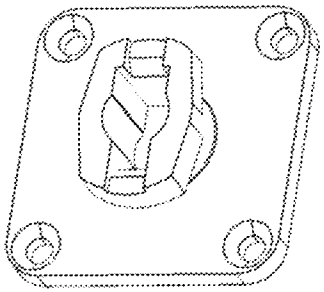

FIGS. 16A-16F illustrate various expanded views of further components of the low profile lighting adapter 100 described herein. FIGS. 16A and 16B illustrate top-down perspective views of a first housing section (e.g., 102 illustrated in FIG. 1), and FIG. 16C illustrates a bottom-up perspective view of the first housing section. As described herein, the first housing can be inserted into a second housing section, illustrated in FIGS. 16D, 16E, and 16F. The first housing section includes a depression 161 configured to enable actuation of a live electrical connection, such as electrical connection 112 illustrated in FIG. 4. The movement of the live electrical connection is facilitated by a bracket which is disposed within depression 161, such as bracket 150 illustrated and described with regard to FIG. 12A. The first housing section further includes a notch 162 which allows the live electrical connection to extend beyond the top surface of the first housing section. Opposite of the depression 161, the first housing section includes a second notch 163, configured to receive a ground connection, such as electrical ground connection 110 illustrated and described with regard to FIG. 2. FIGS. 16D and 16F illustrate top-down perspective views of the second housing section (e.g., 103 illustrated and described with regard to FIG. 2), whereas FIG. 16E illustrates a bottom-up perspective view of the second housing section. As described herein, the second housing section is configured to couple with and receive the first housing section (e.g., illustrated in FIGS. 16A-C), as well as the housing (e.g., illustrated in FIGS. 15D-F). The second housing section includes depressions 164 and 165, configured to receive a neutral electrical connection and a live electrical connection, respectively. While FIG. 16A illustrates a notch 162 which enables a first live electrical connection to actuate up and down, depression 165 is configured to hold a second live electrical connection in a static position, such that one live electrical connection is configured actuate.

Figure 17A:
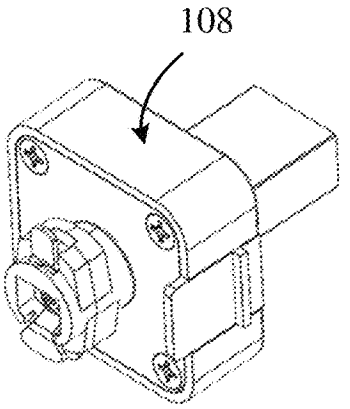
FIGS. 17A-17G illustrate various stages of disassembly of the low profile lighting adapter in accordance with the present disclosure.
Figure 17B:
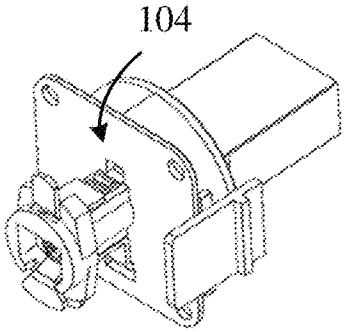
Figure 17C:
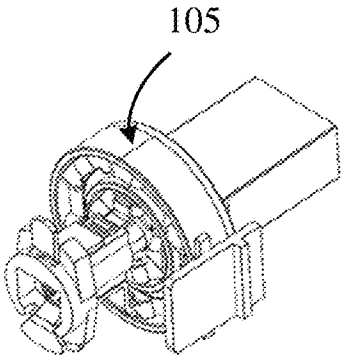
Figure 17D:
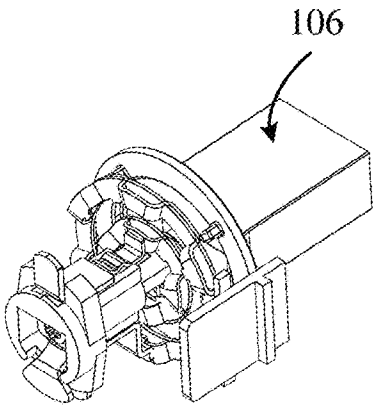
Figure 17E:
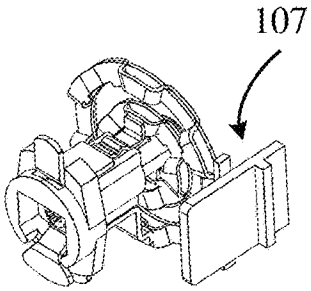
Figure 17F:
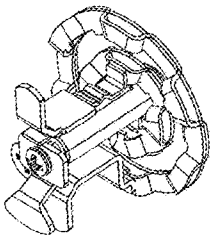
Figure 17G:
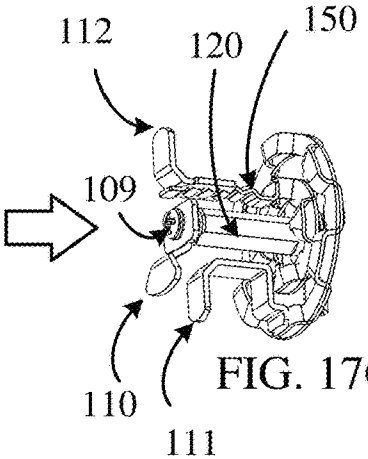

FIGS. 17A-17G illustrate various stages of disassembly of the low profile lighting adapter 100 in accordance with the present disclosure. FIG. 17A illustrates the fully assembled low profile lighting adapter as described herein, without the second housing section (e.g., 103 illustrated in FIG. 1). FIG. 17B illustrates the low profile lighting adapter with the housing 108 removed. FIG. 17C illustrates the low profile lighting adapter with the top plate 104 removed. FIG. 17D illustrates the low profile lighting adapter with the bottom holder 105 removed. FIG. 17E illustrates the low profile lighting adapter with the extending arm 106 removed. FIG. 17F illustrates the low profile lighting adapter with the lock clip 107 removed. FIG. 17G illustrates the various electrical connections and ring assemblies of the low profile lighting adapter. As illustrated, the electrical ground connection 110, is secured between the ground screw 109 and the ground bolt 120.

It will be appreciated by those of skill in the art that the disclosed embodiments can be used in combination with lighting tracks of virtually any manufacture. Generally, these systems all connect a live, neutral and ground to a linear track. As one example, some luminaires have three metal tabs, and others have two tabs. Corresponding two circuit tracks will have four copper "channels" for live 1, live 2, neutral, ground and three channels for L1, L2, and neutral.

Some luminaire adapters require placing the adapter in the lighting track and then turning the entire adapter 90 degrees to make electrical contact with conductors in the lighting track. Other are inserted into the track and a knob located on the adapter is turned making the electrical contact (as compared to rotating the entire adapter). The rotatable electrically transmissive couplings described herein can also be applied to this type of lighting adapter.

The present disclosure has described one or more preferred embodiments. However, it should be appreciated that many equivalents, alternatives, variations, and modifications, aside from those expressly stated, are possible and within the scope of the invention.

The invention claimed is:

1. A lighting adapter configured to be received by a lighting track, comprising:

a housing including a plurality of electrical conductors directed therethrough, wherein at least one of said electrical conductors includes at least one slidable conductive portion and a second portion, the at least one slidable conductive portion being configured to slide over and with respect to the second portion to permit a lengthwise adjustment of said electrical conductor, wherein the at least one slidable conductive portion can be slid with respect to the second portion to contact at least one of a plurality of different conductors in a light track; and at least one rotatable conductor permitting continuous rotatable adjustment of the lighting adapter about an axis of rotation while maintaining electrical continuity through said at least one rotatable conductor, wherein said at least one rotatable conductor includes at least one conductive ring having an undulating shape along a circumferential direction.

2. The lighting adapter of claim 1, wherein the at least one slidable conductive portion slides along a linear direction with respect to the second portion.

3. The lighting adapter of claim 1, wherein a first portion of said at least one slidable conductive portion further includes an angled portion that is configured to contact said at least one conductor in said lighting track.

4. The lighting adapter of claim 3, wherein said angled portion is oriented orthogonally with respect to a remaining portion of the at least one slidable conductive portion.

5. The lighting adapter of claim 1, wherein the at least one slidable conductive portion is configured to make electrical contact with a first electrical circuit in said lighting track in a first position, and to make electrical contact with a second electrical circuit in the lighting track in a second position.

6. The lighting adapter of claim 1, wherein the at least one rotatable conductor can be rotated in excess of 360 degrees.

7. The lighting adapter of claim 1, wherein the at least one rotatable conductor can be rotated in excess of 720 degrees.

8. A lighting adapter configured to be received by a lighting track comprising:

a housing including a plurality of electrical conductors directed therethrough, wherein at least one of said conductors includes at least one rotatable conductor permitting continuous rotatable adjustment of the lighting adapter about an axis of rotation while maintaining electrical continuity through said at least one rotatable conductor, wherein said at least one rotatable conductor includes at least one conductive ring having an undulating shape along a circumferential direction.

9. The lighting adapter of claim 8, wherein the at least one rotatable conductor can be continuously rotated in excess of 370 degrees.

10. The lighting adapter of claim 9, wherein the at least one rotatable conductor can be rotated in excess of 400 degrees.

11. The lighting adapter of claim 8, wherein the at least one rotatable conductor does not include a rotational stop.

12. A low profile lighting adapter, comprising:

a first housing section configured to hold an electrical ground connection;

a second housing section configured to couple with the first housing section, the second housing section including a planar surface and an extension orthogonal to the planar surface, the extension configured to couple with the first housing section;

a first electrical lead disposed between the first housing section and the second housing section;

a second electrical lead disposed in the first housing section and opposite of the electrical ground connection, wherein the first housing section is configured to allow individual actuation of the second electrical lead along first direction by a relative sliding action along and with respect to a further conductor, wherein a first end of said second electrical lead slides along said further conductor; and an extending arm coupled to the second housing section and configured to configured to receive a lighting apparatus.

13. The low profile lighting adapter of claim 12, wherein the extending arm is configured to allow the lighting apparatus to rotate about a first axis without an angular rotational limit.

14. A lighting system, comprising the lighting adapter of claim 1, and a lighting track configured to couple with the lighting adapter.

15. A lighting system, comprising the lighting adapter of claim 6, and a lighting track configured to couple with the lighting adapter.

16. A lighting system, comprising the lighting adapter of claim 8, and a lighting track configured to couple with the lighting adapter.

* * * * *